United States Patent [19]

Greenhut

[11] Patent Number: 4,463,462

[45] Date of Patent: Aug. 7, 1984

[54] SHOWER DISPENSER CONTAINER-RECEIVER COUPLING SYSTEM

[75] Inventor: Bart E. Greenhut, Los Angeles, Calif.

[73] Assignee: L'Aimee Laboratoires, Ltd., Los Angeles, Calif.

[21] Appl. No.: 415,229

[22] Filed: Sep. 7, 1982

[51] Int. Cl.[3] ..... A47K 3/22

[52] U.S. Cl. ..... 4/605; 4/597; 239/310; 239/318

[58] Field of Search ..... 4/597, 596, 605; 239/310, 318, 428.5

[56] References Cited

U.S. PATENT DOCUMENTS

| | | | |
|---|---|---|---|
| 2,058,901 | 10/1936 | McPherson | 239/310 X |
| 3,106,345 | 10/1963 | Wukowitz | 239/310 X |
| 3,199,788 | 8/1965 | Davis | 239/310 |
| 3,231,200 | 1/1966 | Heald | 239/310 X |
| 3,797,747 | 3/1974 | Buzzi et al. | 239/428.5 X |
| 4,121,773 | 10/1978 | Headen et al. | 239/318 X |

*Primary Examiner*—Henry K. Artis

*Attorney, Agent, or Firm*—Freilich, Hornbaker, Rosen & Fernandez

[57] ABSTRACT

A system is described for connecting a bottle to a shower dispenser, which enables connection with only a small angle of turning, which latches the bottle in position while permitting detachment, and which avoids leakage of material during dispensing. The bottle, or container, has a cam on its neck, and the shower dispenser receiver into which the container can be screwed has a slot forming a detent that is deflected by the cam as the container is turned, to resist unscrewing of the container. The bottom of the slot that forms the detent, also forms a stop that prevents further screwing in of the container. The receiver has an internal cylindrical projection that is closely received within the container neck, and which substantially abuts an internal flange within the container, to minimize leakage of liquid during dispensing.

9 Claims, 9 Drawing Figures

FIG. 4
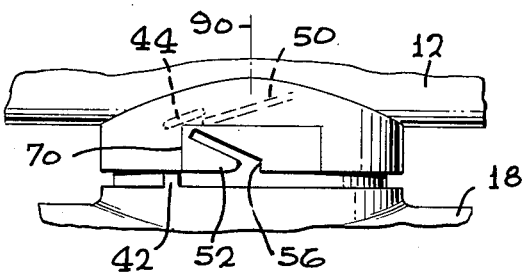
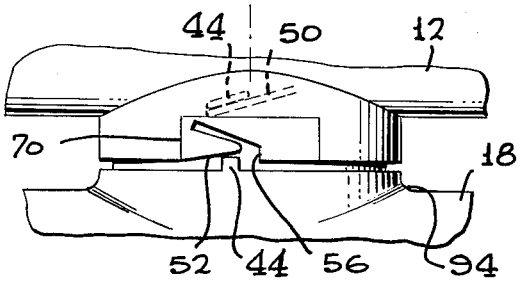
FIG. 5
FIG. 6
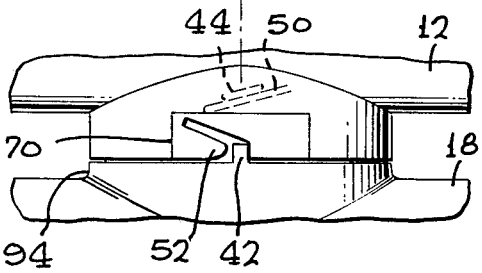
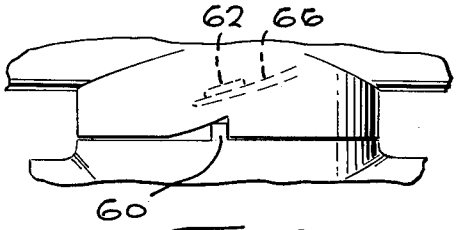
FIG. 7
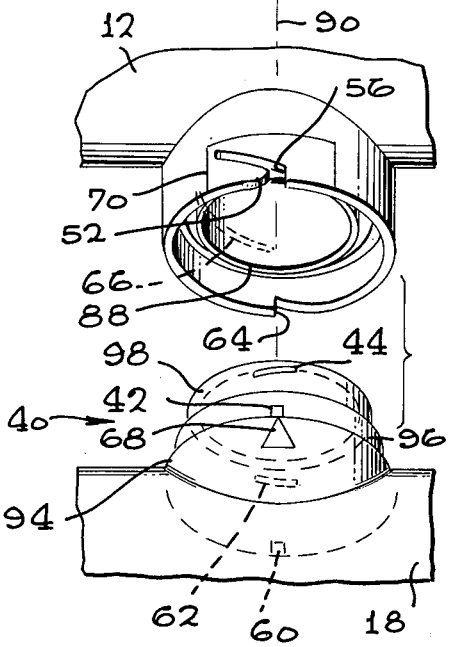
FIG. 8
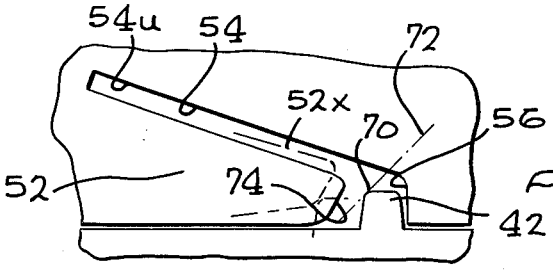
FIG. 9

SHOWER DISPENSER CONTAINER-RECEIVER COUPLING SYSTEM

BACKGROUND OF THE INVENTION

A shower dispenser, such as of the type shown in U.S. patent application Ser. No. 108,130 filed Dec. 28, 1978, for Shower Dispenser, can use replaceable bottles of bath oil that must be constructed at low cost and yet be quickly and securely connected to the dispenser. The dispenser allows only a small amount of room for turning the container, so it must be installable by turning it by only a small part of a complete circle. It is also desirable that the container be firmly latched in place after installation, so it is not accidentally turned a small amount that would enable it to be released and fall on the shower floor. Furthermore, it is desirable to prevent any noticeable leakage of bath oil even when the container is lifted to dispense oil into the receiver. A system for coupling the container to the receiver which enabled installation by turning only a small part of a circle, which then latched the container in position, and which provided a secure connection that avoided leakage, all in a coupling system of low cost, would be of considerable value.

SUMMARY OF THE INVENTION

In accordance with one embodiment of the present invention, a container-receiver coupling system is provided which can be manufactured at low cost and which enables attachment of a container to a shower dispenser receiver after only a small amount of turning, and latching of the container in position and with a secure leak-resistant connection between them. The receiver has an opening for receiving a neck on the container, and has an internal thread for engaging a corresponding thread on the container neck as it is turned. The receiver has a slot forming a resilient detent in the walls of its opening, and the neck of the container has a cam that deflects the detent as the container is screwed in, and with the detent springing back behind the cam after the container is installed to resist removal of the container. The bottom of the slot in the receiver can also serve as a stop that engages the cam to prevent substantial turning of the container after the cam thereon passes the detent. The receiver can be provided with a cylindrical projection that closely fits within the neck of the container and which substantially abuts an internal flange on the neck, to resist leakage of fluid from the container when it is raised to dispense liquid into the receiver.

The novel features of the invention are set forth with particularity in the appended claims. The invention will be best understood from the following description when read in conjunction with the accompanying drawings.

BRIEF DESCRIPTION OF THE DRAWINGS

FIG. 4 is a front elevation view of the system of FIG. 3, shown at the beginning of container installation.

FIG. 5 is a view similar to FIG. 4, showing the container in a later position during installation.

FIG. 6 is a view similar to FIG. 5, but showing the container after full installation.

FIG. 7 is an exploded perspective view of the system of FIG. 3.

FIG. 8 is a rear elevation view of the system of FIG. 7.

FIG. 9 is an enlarged view of a portion of the area of FIG. 6.

DESCRIPTION OF THE PREFERRED EMBODIMENTS

Figure 1:
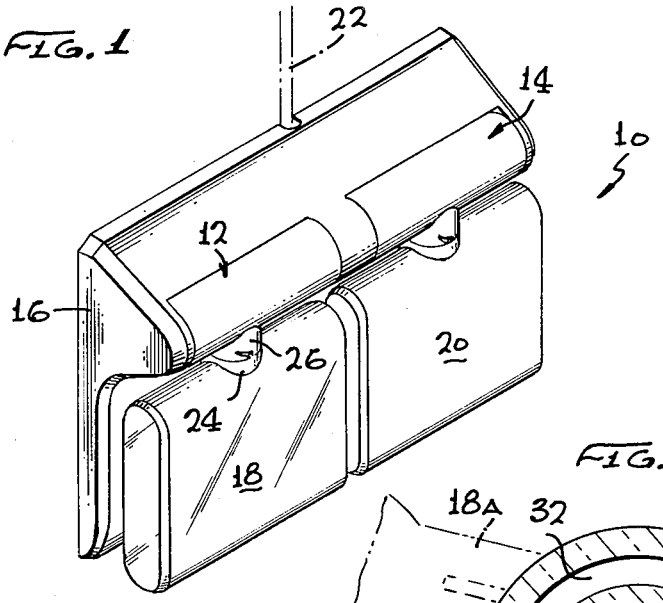
FIG. 1 is a perspective view of a shower dispenser which uses the container-receiver coupling system of the present invention.

FIG. 1 illustrates a shower dispenser 10 which includes a pair of receivers 12, 14 pivotally mounted on a frame 16, and which hold bottles 18, 20 containing bath oil. A quantity of bath oil can be dispensed through a shower head, by lifting one of the bottles such as 18 to cause the bath oil to be drawn upwardly through a tube 22 that extends to the shower head (not shown). When a container such as 18 is empty, it is removed and a new container is installed on the receiver 12. The present invention is directed to a system that can couple a neck 24 on the container to a container-receiving portion 26 on the receiver and which enables easy removal of a container and rapid and secure installation of a replacement container, while enabling construction of the receiver and especially the container at low cost.

Figure 2:
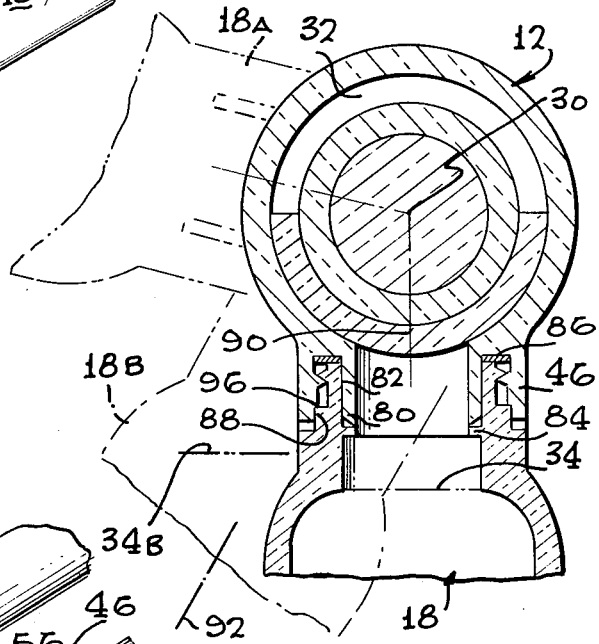
FIG. 2 is a sectional view of the system of FIG. 1.

FIG. 2 illustrates the manner in which the container 18 which has been installed on the receiver 12, can be raised by pivoting of the receiver about its axis of pivoting 30. When the container is pivoted up to the position 18A, fluid can flow into a resevoir 32 from which it is dispensed through a shower head. In order to install the container 18 on the receiver, the receiver must be pivoted up as to position 18B to provide space for turning the container. Where the original height of fluid is at 34, it is desirable not to have to pivot the container much past the position 18B at which it is tilted about 30° from the vertical, otherwise there is danger that the fluid level, which is now at 34B will allow bath oil to spill out of the neck of the container. If the container need be turned only a small part of the circle, then it will be necessary to pivot it up only a small angle, such as to 18B, from the horizontal to provide sufficient room for such turning.

Figure 3:
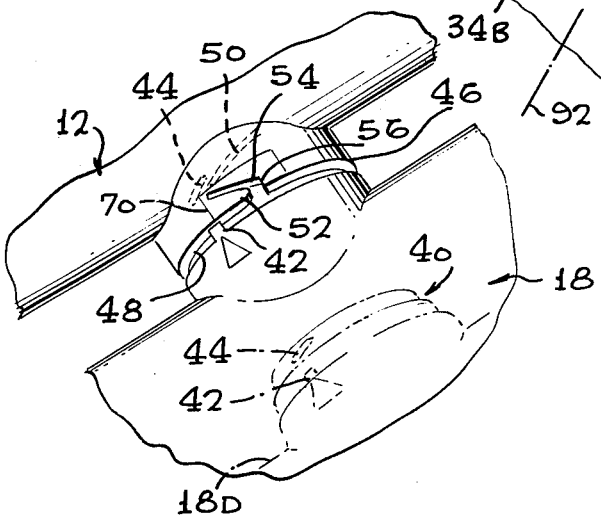
FIG. 3 is a perspective view of the system of FIG. 2, shown with the container and receiver tilted from the vertical and at the beginning of installation of the container.

FIG. 3 shows the manner in which the container 18 is initially positioned to install it on the receiver 12. The container shown at 18D, includes a neck 40 with a cam 42 near the bottom of the neck that projects radially therefrom, and a thread section 44 near the top of the neck that projects radially outwardly therefrom. The receiver 12 has walls 46 forming a downwardly-facing opening 48 for receiving the neck, and forming an internal thread 50 that can threadably engage the thread section 44 on the container neck. The container is initially installed by projecting the neck into the receiver opening 48 so that the thread section 44 can engage the receiver thread 50 after slight turning of the container. As the container is then turned clockwise by a small angle, the dam 44 will deflect a detent 52 formed by a slot 54 in the receiver walls, and then abut a stop 56 at the bottom of the slot.

FIG. 5 shows how the detent 52 is deflected upwardly by the cam 42 as the container 18 is turned. During turning of the container, the cam 42 moves along an upward incline, by reason of engagement of the container thread section 44 with the receiver thread 50. As shown in FIG. 6, when the cam 42 has passed the detent 52, the detent springs down again to serve as a latch lying in the path of the cam 42 during unscrewing of the container. Also, the cam then abuts the stop 56 formed at the bottom of the slot 54. The container therefore cannot turn back or forth by more than a few degrees, and therefore is perceived by the user to be securely installed. As shown in FIG. 7, the container is provided with another cam 60 at its rear, and another thread section 62 thereat, which respectively engage a second stop 64 and second thread 66 at the rear of the receiver 12. The provision of two thread sections 44, 62 that are both engaged, provides more secure holding of the container. The use of two substantially identical cams or locks 42, 60 at opposite sides of the container, enables installation of the container even if the user has mistakenly placed the front of the container at the rearward position. It may be noted that a triangular marker 68 is formed at the front of the container to point at the cam 42, to indicate that the cam should be placed immediately to the left of another molded indicator 70 (FIG. 3) on the receiver.

To remove a container a user merely lifts the container to pivot upward by perhaps 30°, and then turns it counterclockwise. The detent 52 resists counterclockwise movement of the cam 42 thereby, but permits it when the container is forcefully turned. FIG. 9 shows that the upper, left side corner 70 (i.e. the counterclockwise side) of the cam 42 is angled, as by rounding the corner, so that the location which will first engage the detent 52 extends at an upward clockwise incline indicated by the line 72. In addition, the rightward edge 74 of the detent, at the location that first engages the cam 42 during container removal, extends at an upward-clockwise incline. Thus, as the container is first unscrewed, the cam 42 lifts the detent to the position 52X to permit the container to be unscrewed while providing noticeable resistance to such turning. The right side of the cam 42 is preferably formed to extend largely vertically to firmly engage the slot surface 56. The slot 54 in the receiver walls is formed with a bottom that extends largely vertically, at least at the right side where it forms the stop 56, and has an upper portion 54*u* that extends at an upward-counterclockwise incline.

As mentioned earlier, to dispense liquid from the container, it must be raised by pivoting it more than 90° from the vertical, as to the position 18A (FIG. 2). It is desirable to avoid leaking out of bath oil during such raising of the container, since this could leave a residue on the dispenser that would detract from its appearance. To minimize such leakage, the receiver is provided with a cylindrical projection 80 that can be closely received within a cylindrical passage 82 formed at the top of the neck of the container. The container is also formed with an internal flange 84 spaced from the top of the container neck, which substantially abuts the bottom of the cylindrical projection 80 from the receiver. There is little or no gap between the bottom of the projection 80 and the flange 84 through which bathing oil can leak. In addition, a washer 86 is provided at the top of the space 88 between the walls 46 forming the opening and the projection 80.

In a system of the illustrated type, that has been constructed, the container 18 required a rotation of about 30° about a vertical axis 90 (FIG. 2) to install it from the position of FIGS. 3 and 4 to the position of FIG. 6. It required lifting of the container to the position 18B (FIG. 2) at which the axis 92 of its neck had been tilted about 30° from the vertical, to provide sufficient room to enable the container to be rotated about 30°. The container neck 40 (FIG. 7) was constructed with a cylindrical base portion 94, a lowermost cylindrical portion 96 from which the cam 42 projected, and an upper cylindrical portion 98 from which the thread section 44 projected. This permitted the lower cylindrical portion 96 to be closely surrounded by the bottom of the receiver opening, as shown in FIG. 2. Since only the detent of the receiver had to flex, the container could be made of relatively low cost rigid plastic.

Thus, the invention provides a container-receiver coupling system for a shower dispenser, that facilitates the installation of the container on the receiver by requiring it to be turned by only a small portion of a circle, which securely latches the container in its installed position, which minimizes leakage of bath oil from the container when it is raised, and which enables the parts to be constructed at low cost. The receiver can be constructed with a resilient detent in the walls of its container-receiving opening, and the container can be constructed with a cam, so that as threads of the container advance along threads of the receiver, the cam deflects the detent and then is latched in front of it. The receiver can be provided with a cylindrical projection that is closely received in the container neck, and which substantially abuts an inner flange in the container to block the leakage of fluid from the container when it is raised.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. A shower dispenser container-receiver coupling system comprising:

a shower dispenser receiver having walls forming an opening and a thread inside the opening; and a container having a neck that can be received in the receiver opening, a thread on the neck that mates with the receiver thread, and a cam;

the walls of said receiver that form said opening, forming a resilient detent located in the path of said cam as the container is turned to screw the container thread on the receiver thread, said detent positioned so that as the container is screwed in the detent is first deflected out of the way of the cam and then released to lie behind said cam to resist unscrewing of the container, said receiver walls also forming a stop that prevents substantial further container rotation past the position at which the detent is released.

2. The system described in claim 1 wherein:

said receiver opening faces generally downwardly and said receiver walls form a through slot having a bottom that opens to the bottom edge of said receiver walls and having an upper portion extending at an upward incline in a counter-clockwise direction to form a detent between the slot and said bottom edge.

3. The system described in claim 2 wherein:

the bottom portion of said slot has left and right sides, the left side forms the free end of said detent and said free end is angled at an upward-clockwise incline to facilitate its upward deflection by said cam during unscrewing of the container.

4. The system described in claim 1 wherein:

said receiver has a cylindrical projection of smaller outside diameter than the inside of said container neck, lying within said walls forming an opening; and said container neck has an internal flange spaced below the top of the neck and positioned to substantially abut the bottom of said projection when the container is fully installed on the receiver.

5. A container that can be easily connected to a shower dispenser receiver by turning the container by no more than about 30°, comprising:

a container having a main body and having a neck extending upwardly from the main body, said neck having a lower cylindrical neck portion with a cam projecting radially outwardly from the bottom of the periphery thereof, and said neck having an upper cylindrical neck portion with a thread section extending outwardly therefrom.

6. The container described in claim 5 including:

a shower dispenser receiver having walls forming an opening with a bottom edge, that can closely receive said neck, and forming an internal thread starting a distance above said bottom edge to threadably engage the thread on said container neck;

said walls forming said opening having a slot which extends vertically into said bottom edge and which then extends at an upward incline to form a detent between the slot and the bottom edge of the opening walls;

said internal thread being located high enough that as the thread on the neck screws along the internal thread on the receiver walls, the cam is progressively raised against the detent to deflect it; and the bottom of said slot being wide enough to accept the full width of said cam.

7. The container described in claim 5 wherein:

said cam has a largely vertically extending right side, as seen from the outside of the container when the neck is pointing upwardly, so the cam can positively engage a stop, and said cam has a left side surface that extends at an upward-rightward incline at the top of the cam.

8. The container described in claim 5 including:

a shower dispenser receiver with walls forming a downwardly-facing opening for receiving said container neck, said walls forming an internal thread for engaging said thread on said neck, and said walls forming a detent which is positioned to be deflected by said cam and then lie behind said cam as the neck threads into the opening;

said receiver having an inner cylindrical projection lying within said walls that form an opening, said inner projection being of slightly smaller outer diameter than the inside of said container neck to fit closely therein.

9. The container described in claim 5 wherein:

said neck has a cylindrical passage and an inwardly extending flange at the bottom of said passage.

* * * * *